United States Patent [19]

Bowers

[11] Patent Number: 5,006,837

[45] Date of Patent: Apr. 9, 1991

[54] PROGRAMMABLE VIDEO GRAPHIC CONTROLLER FOR SMOOTH PANNING

[76] Inventor: John J. Bowers, 4509 Coddingville Rd., Medina, Ohio 44256

[21] Appl. No.: 303,280

[22] Filed: Jan. 26, 1989

[51] Int. Cl.[5] ..... G09G 5/38

[52] U.S. Cl. ..... 340/724; 340/726; 340/799

[58] Field of Search ..... 340/724, 726, 734, 798, 340/799

[56] References Cited

U.S. PATENT DOCUMENTS

| | | | |
|---|---|---|---|
| 4,197,590 | 4/1980 | Sukonick et al. | 340/726 |
| 4,295,135 | 10/1981 | Sukonick | 340/734 |
| 4,442,495 | 4/1984 | Sukonick | 340/726 |
| 4,491,834 | 1/1985 | Oguchi | 340/726 |
| 4,549,275 | 10/1985 | Sukonick | 340/726 |
| 4,570,161 | 2/1986 | Kummer et al. | 340/799 |
| 4,611,202 | 9/1986 | DiNitto et al. | 340/724 |
| 4,714,919 | 12/1987 | Foster | 340/726 |
| 4,803,478 | 2/1989 | Olsen | 340/726 |

*Primary Examiner*—Jeffery A. Brier

*Attorney, Agent, or Firm*—Oldham & Oldham

[57] ABSTRACT

A display system including a programmable video graphic controller allows for continuous smooth panning through memory which is larger than the system's video memory. The video memory is continuously updated with new image data so as to form two duplicate images within video memory. When an edge of video memory is reached, the displayed image may be shifted from one of the duplicate images to the other within video memory to allow continuous panning without the need to stop and refresh the image data every time an edge of video memory is reached.

15 Claims, 5 Drawing Sheets

PROGRAMMABLE VIDEO GRAPHIC CONTROLLER FOR SMOOTH PANNING

BACKGROUND OF THE INVENTION

This invention relates generally to data display and control systems and more particularly to graphics controllers which are programmable to enable smooth panning capabilities beyond the video display memory limit.

Various systems have been realized to display computer graphics information so as to make manipulation and use of such information both easy and flexible. The conventional graphic system includes a CRT which is controlled by a display control system which may comprise a CRT controller, a visual attribute generator, as well as memories including display and screen memories and serial digital memories or random access digital memories. With such systems, by displaying data on the screen of a raster-scan cathode ray tube the resulting display pictures can be of very high complexity and may include other display options.

For many application it is desired that the user be able to sort through textual or graphic information in a video display system both quickly and easily. The scroll and pan functions which have been developed to enable the user to more rapidly view data have been improved so as to smoothly move the data over the screen. In one improved system as shown in U.S. Pat. No. 4,714,919, there is disclosed a video display system and method for continuous smooth scrolling in which the video image is displaced upwardly one scan line by means of a display vertical position control and new data is accessed by corresponding start address updating in video memory. In this system, the operation of the display vertical position control must coincide with the vertical sync pulse interval and is restricted by the video display memory limit.

The panning capability is also very important in many applications such as a display of wave form data such as pressure, physical potentials, temperature, electrical drift and the like. In one system as found in U.S. Pat. No. 4,442,495, there is shown a video display system and panning control system in which graphic image data is accessed from a video memory which has a larger dimension than that which may be viewed on the screen of a CRT. In the excess memory there is stored image data which forms a continuation of the image displayed such that panning into the excess memory is enabled. There is also provided a rewrite area in video memory for inputting new information which may subsequently be viewed on the screen according to timing circuits which limit the rate at which panning can occur. Although smooth panning is enabled by this system, the rate of panning is limited and the screen must be refreshed when the video memory limit is reached.

In other systems, the screen memory can be moved about in the video memory by use of graphics controllers such as the Enhanced Graphics Adapter and Video Graphics Array as developed by IBM and included in graphic display systems of personal computers such as the IBM PC/2. The memory configuration of these graphic controllers may include 256K of display memory configured as four 64K planes. In this system, each scan line on the screen will have a default length of 80 bytes of video memory.

The graphic controller hardware supports logical line lengths allowing one to configure a number of display memory bytes which will equal one screen width. Thus, the logical screen width may be set to be greater than the actual screen width whereby panning can be achieved within the limits of the video memory.

A horizontal pixel panning register forming part of the visual attribute generator in the graphic controller is a read/write register pointed to by the value in the attribute address register. The register allows the video image to be panned up to 8 pixel positions in certain video modes and continuous panning is achieved by incrementing the panning register in accordance with the screen refresh rate. When the maximum number of pixels which can be panned is reached, the horizontal panning register may be reset and the start address in the CRT controller changed to accomplish further panning.

A problem with the smooth panning accomplished by the horizontal panning register is found in that when the limits of the video memory are reached at the normal end of line data, the data panned into the image will be that of the next scan line giving a wrap around effect from one edge of the screen to the other. This effect can be avoided by programming the offset register in the CRT controller sub-section to set a logical screen width which is wider than the actual screen or providing space between scan lines in video memory. The offset register is bit oriented and increasing the value of the logical screen width provides extra memory bytes between each scan line.

Normally in such a system, the offset register is programmed in mode HEX 10 such that the next row is larger than the current row by 80. Incrementing of the display start address in the CRT controller sub section may be accomplished at the beginning of the vertical retrace of each screen so no flicker or jerky movement of the display will be seen. Although smooth pan may be accomplished, it is not possible to smooth pan in this video mode without refreshing the entire screen memory after every pan. Thus, such a system is somewhat ineffective in the smooth panning and display of any dynamic data and is unable to be used with real time data acquisition and display requirements. Some systems have been developed to accelerate the speed at which smooth panning may be accomplished, but these have been of relative high cost and complexity thereby inhibiting their general use.

SUMMARY OF THE INVENTION

In view of the prior art there has been found a need to pan through memory which is larger than video memory without having to stop to refresh the video each time of the edge of the video memory is reached. It is therefore a main object of the invention to provide a method of operating a display system for displaying data from a video memory to allow panning through memory which is larger than the video memory of this system.

It is a further object of the invention to provide a method of operating a display system wherein new data may be placed in video memory without the necessity of stopping to refresh all of the video each time an edge of video memory is reached.

It is yet another object of the invention to enable a real time plot of acquired data to be constructed by the method of operating display system of the invention in a continuous smooth panning format.

Still another object of the invention is to enable graphic information such as grid, amplitude or timing lines to be displayed in conjunction with other graphic information wherein the timing lines or the like need not be refreshed continuously during panning.

Another object of the invention is to overcome the speed limitations of bit-mapped graphics-based plotting capabilities by the method of operating a display system so as to enable bi-directional smooth horizontal pan without flashing or jerking of the graphics images.

These and other objects may be accomplished by the method of operating a display system which includes manipulation of the data within the memory of the display system so as to allow panning through memory which is larger than the video memory. The method comprises the steps of first defining the logical screen width within the video memory to be a predetermined width relative to the screen memory. An offset register of a CRT controller may be utilized to set the logical screen width to be at least two times wider plus one byte than the physical screen width. In this way, data of the next scan line in the display is not visible while the video memory is being updated with newly acquired data which falls outside of the video memory. The start address of the screen memory is set at a predetermined length from the edge of the video memory and first and second identical columns of data can then be stored in the video memory at predetermined positions. The display memory is configured as four 64K byte planes wherein scan lines on the screen will have default lengths of 80 bytes of memory.

In the preferred embodiment, the start address of the screen memory is set 8 bytes to the right of the left edge of video memory and first and second identical strips of data are simultaneously placed in video memory 88 bytes apart. The screen memory may then be panned to the right to view that part of video memory placed just to the right of screen memory in its starting position. Panning is accomplished by updating the pixel position so as to move the screen memory through a predetermined number of pixels within the video memory. The start address of the screen memory may then be updated when a maximum of the video mode utilized is reached and the pixel positions are again updated resulting in continuous pixel panning of the video memory found in the second strip of data placed therein.

Subsequently, further first and second identical columns of data may be updated into video memory to enable the panning function to continue for real time or previously stored data display. This process continues until all of video memory is filled with new data and has been viewed by panning. It should be recognized that by filling video memory with identical strips of data at predetermined positions in the video memory, two duplicate memory images will be placed in video memory. At this point the screen memory is again set at its predetermined length from the edge of the video memory and new data is put into the initial first and second strips of data as previously described. In this way, the method allows new data to be placed in video memory without stopping to refresh all of the video each time an edge of video memory is reached.

The duplicate image being placed in memory along with the data which is being viewed forgoes the necessity of keeping track of the start address of the screen memory to remain within the bound of video memory and avoids wrapping of the image from one edge of the screen to the other when panning extends beyond the edges of video memory. Although the method yields a very versatile and flexible display system it is found to be extremely cost effective and functions without the addition of complex hardware or program functions.

BRIEF DESCRIPTION OF THE DRAWINGS

These and other objects along with the advantages of the present invention will be readily apparent by reference to the following detailed description when considered in conjunction with the accompanying drawings, wherein.

DETAILED DESCRIPTION OF THE INVENTION

Figure 1:
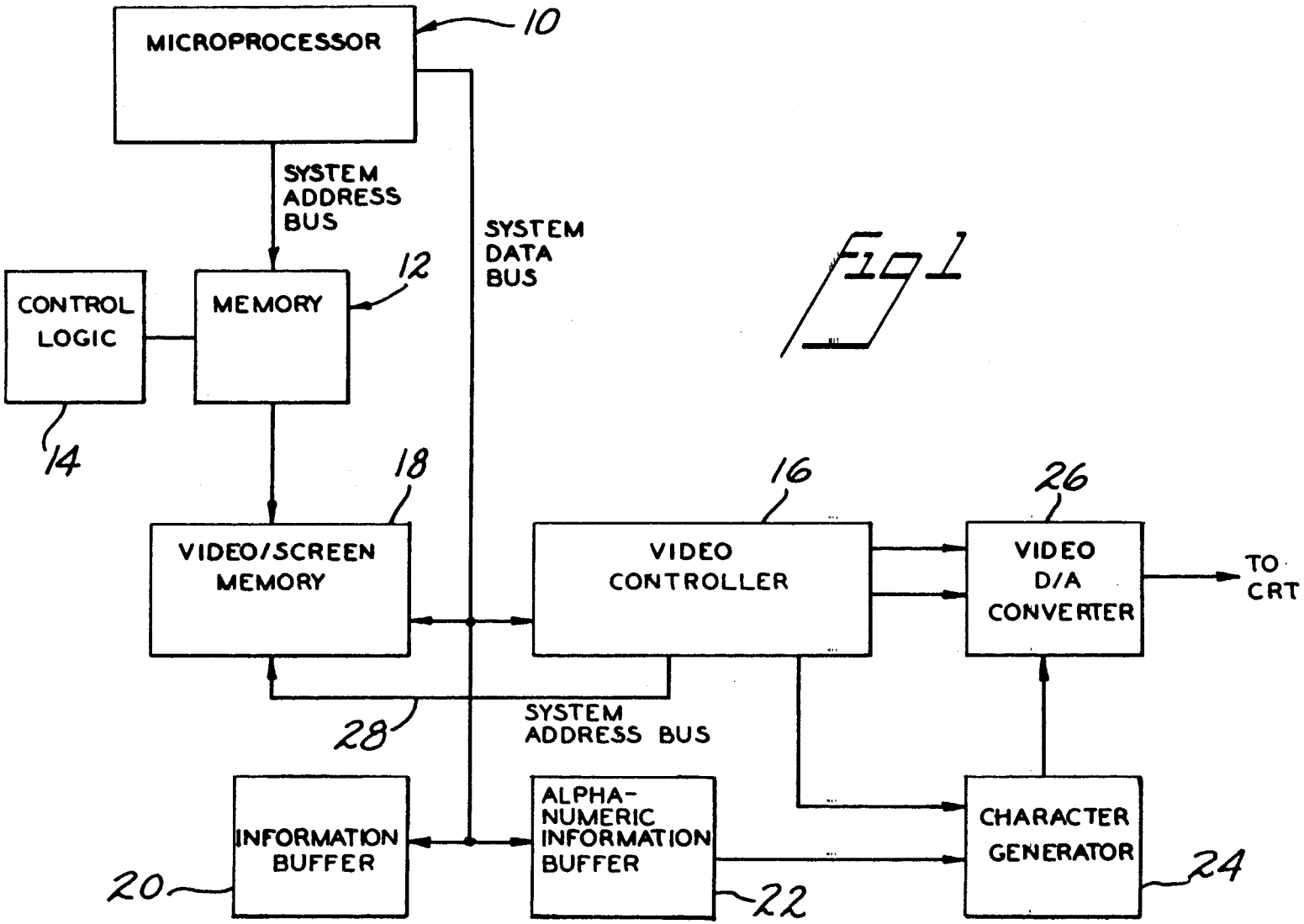
FIG. 1 is a simplified block diagram showing a video display system including video controller sub-section.

Referring now to the drawings, there is shown in FIG. 1 a simplified block diagram of the display system utilizing a video controller sub-system utilized for functions such as smooth panning. The display system comprises a microprocessor 10 which may be programmed so as to respond to input controls and for supplying and controlling a visual display system such as a cathode ray tube (CRT) device (not shown). A host computer including microprocessor 10 may also include memory 12 for storing control and function information as well as data. The memory 12 may constitute a read-only memory (ROM) and/or a dynamic random access memory (RAM) which may be accessed by the micro processor 10 for input and output of data in the conventional manner. The operations of a micro processor 10 as well as reading and writing from system memory 12 is managed by control logic 14 for data control and management.

The video display system includes video controller 16 which acts as an interface between micro processor 10 and video memory 18 which stores the image data to be displayed therein. The display system may also be provided with data buffers such as a graphic information buffer 20 and alphanumeric information buffer 22 which act to temporarily store data from video memory 18 as well as transmitting data to character generator 24. The character generator 24 may be utilized in the translation of image data stored in video memory 18 for display on the CRT in a conventional manner.

The video controller 16 as well as character generator 24 supply image data to a video digital to analog convertor (DAC) 26 so as to transform digital image data into analog form for display on an analog display such as a CRT. It should be recognized in the display system that all image data will pass through the video controller 16 when the system microprocessor 10 reads or writes to video memory 18. Addressing of the video memory 18 is also controlled by the video controller 16 through system address bus 28 such that the starting address of the video memory may be programmed. As will be described in more detail later, the video controller 16 configures the information stored in video memory 18 into eight-byte digital values which are sent to the video digital to analog convertor 26 for display. The eight-byte digital value from video memory 18 accesses registers inside the video DAC 26 for selection of color to be displayed in a color graphics mode or the shade of grey that will be displayed on a monochrome analog display.

The video controller 16 allows for the flexible handling and manipulation of image data for display on an analog display device. The video controller 16 is shown in more detail in FIG. 2 wherein the major components comprise a cathode ray tube controller (CRTC) 30 which generates horizontal and vertical synchronous timings as well as updates addressing for video memory. The CRT controller 30 is connected via system data bus 32 with the system micro processor 32 and is fed timing signals from control and timing logic 34 to generate the display and synchronizing signals for the CRT.

The CRT controller 30 is in turn connected to sequencer 36 which generates memory timings for video memory. The sequencer 36 also allows the system micro processor to access video memory during active display intervals if dedicated system micro processor memory signals are periodically interposed between display memory cycles via system data bus 32.

The display memory comprises random access memories (RAM) 38, 40, 42, and 44 which may each be configured as planes. A graphics controller 46 acts as the interface between video memory and the system microprocessor during video memory reading or writing. The graphics controller 46 enables the performance of logical operations on memory data before it reaches video memory or the system microprocessor data bus during a system microprocessor write or read respectfully. One such logical operation is the capability of writing to the display buffer on non-byte boundaries thereof. The graphics controller also acts as the interface between video memory and an attribute controller 48 during active display times.

During active display times, memory data is latched by the graphics controller 46 and sent to the attribute controller 48 wherein it may be converted and formatted for display on the display screen. The attribute controller 48 allows either A/N mode or APA mode attribute data to be converted to a eight-byte output digital color value which is sent to the video D-to-A convertor 54 for conversion into an analog signal for display. The attribute controller controls panning register 52 which may be used to shift the video image one or more pixel positions on the analog display.

The panning function is enabled by panning register 52 which is a read/write register pointed to by the value in the attribute address register 50. The panning register 52 may select the number of pixels to shift the video data horizontally according to the video mode utilized. The image data from attribute controller 48 as well as the shifted image date from panning register 52 is output to the video digital-to-analog convertor 54 for transformation into an analog display signal. It is also noted that micro processor address information on system address system bus 56 is directed to an input/output multiplexer 58 for writing to video memory as well as supplying the address information to attribute controller 48. It is also mentioned that the CRT controller 30 includes several important registers such as offset register 60 which is a read/write register pointed to when the CRT controller address controller 62 is a certain value. The offset register 60 specifies the logical line width of the video display screen such that the next byte row of the display image may be programmed to be larger than the current byte row by a predetermined amount.

Figure 2:
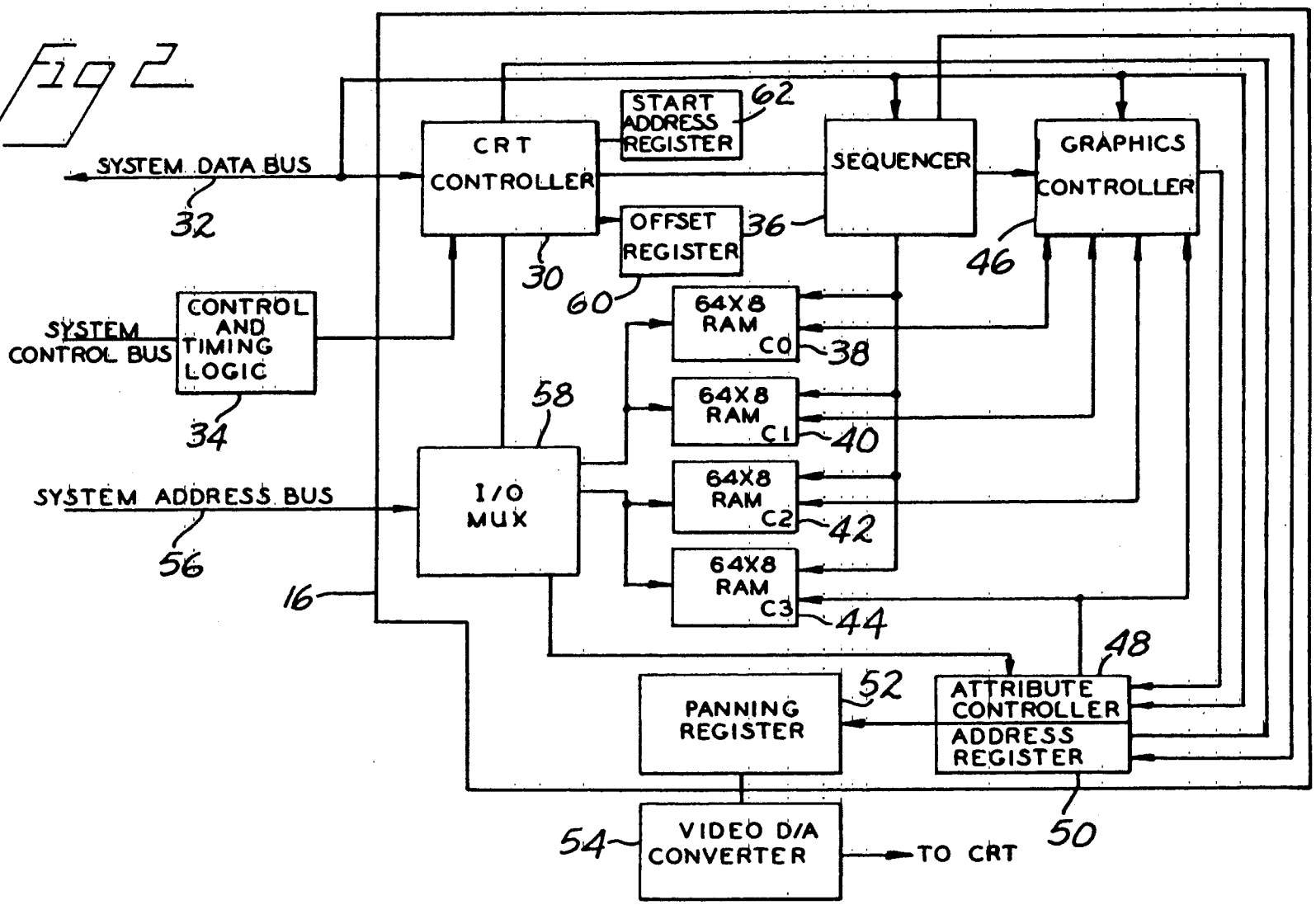
FIG. 2 is a simplified block diagram of a video controller sub-system as shown in FIG. 1.
Figure 3:
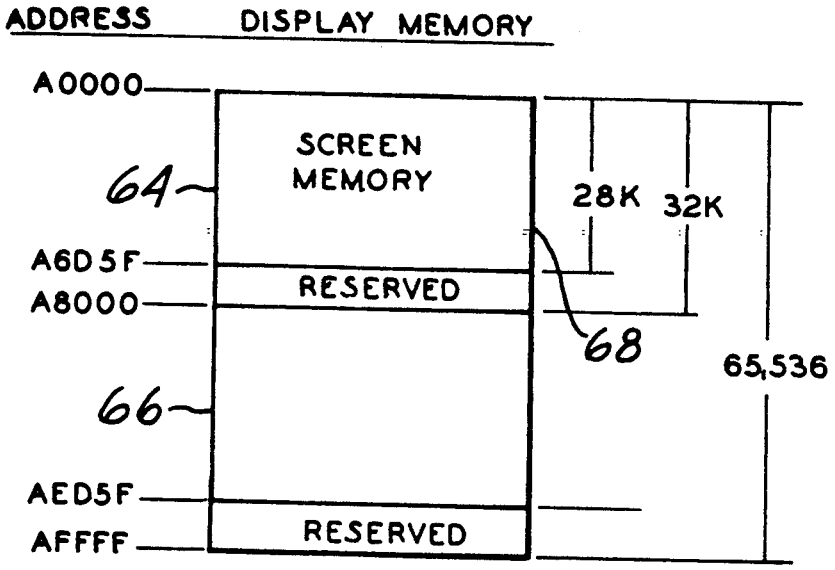
Fig 3 Prior Art
FIG. 3 is a prior art configuration for a video memory forming a part of a video controller such as that shown in FIG. 2.

The panning function controlled by panning register 52 operates to allow the user to shift the video image one or more pixel positions horizontally on the display screen. The panning register 52, initialized by the attribute controller address register 50, allows the video image to be panned up to 8 pixel positions depending upon the video mode utilized. The normal graphics mode such as that utilized by IBM in the use of the Video Graphics Array (VGA) display controller is the video mode Hex 10 which is shown in FIG. 3. In this video mode, the offset register 60 associated with the CRT controller 30, as shown in FIG. 2, configures the display memory such that the next byte row in memory is larger than the current byte row by 80. As shown in FIG. 3, video memory is configured so as to include 28K bytes of screen memory as shown at 64 stored at Hex addresses A0000 to A6D5F. Additional video memory exists as shown at 66 to yield a total memory capacity of 65,536 bytes of video memory. The screen memory shown at 64 comprises that amount of image data which will be visible on the screen of a CRT which normally comprises 350 lines of raster data 80 bytes wide.

Utilizing a panning register 52 as shown in FIG. 2, the screen memory shown at 64 may be moved about in the video memory by modifying registers in the video controller. More particularly, continuous pixel panning can be achieved by incrementing the panning register 52 during each vertical retrace period as determined by the CRT controller 30. When the maximum number of pixels which can be shifted in the particular video mode being utilized is reached, the panning register 52 is reset to a zero value and the start address register 62 of the CRT controller 30 is incremented so as to account for the shifted pixel data. Thereafter panning may be continued by repeating the process just described. In this mode, smoothing panning cannot be accomplished without refreshing the entire screen memory after every pan. It is also a problem in that panning beyond the edges of video memory will cause the screen memory to wrap around creating a problem in the visual display of the data. For example, when the screen memory is panned to the right beyond the right video memory limit as shown at 68, the left side of video memory will then appear on the right side of screen memory yielding a erroneous and confusing display on the CRT.

In the present invention, the configuration of video memory as well as placement of data therein is changed so as to allow smooth panning beyond the video memory limit. The smooth panning operation is able to be performed without having to stop and refresh all of the video every time an edge video memory is reached. The video controller 16 as shown in FIG. 1 is configured in a "smooth panning mode". In reference to FIG. 2, the smooth panning mode comprises programming offset register 60 of the CRT controller 30 such that the next byte row in video memory will be larger than the current byte row by 176. In this regard, the value of the next byte row must be larger than the current byte row by at least 162 or twice the actual screen width plus one byte. Setting of the logical screen width by the offset register 60 in this manner enables video memory to be updated with newly acquired data or data not originally placed in video memory while overcoming the wrap-around effect which occurs when an edge of video memory is reached. By configuring the next byte row in video memory to be larger by at least 162, the data in video memory will not be visible while such memory is being updated.

Figure 4:
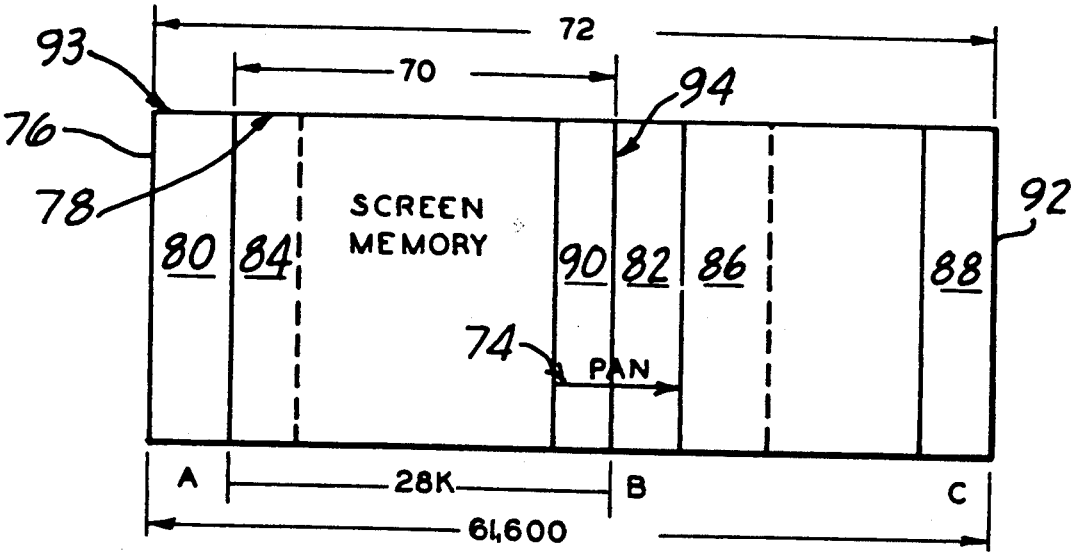
FIG. 4 shows the configuration for video memory of the present invention.

In reference to FIG. 4, the video memory configuration is shown for the smooth panning mode to allow continuous panning beyond the edges of video memory. The screen memory as shown by 70 comprises 28,000 bytes of data being 80 bytes wide by 350 lines for the conventional CRT. Video memory, as shown by 72, is seen to extend beyond screen memory both at the right and left edges of screen memory 70 and is configured to be 176 bytes wide by 350 lines yielding 61,600 bytes of video memory in the preferred embodiment.

In an example of the invention, continuous panning to the right as shown by arrow 74 is accomplished by starting with the screen memory 8 bytes to the right of the left edge 76 of video memory as shown at 78. It should be recognized that panning can occur by shifting a plurality of pixels with the screen memory 70 as previously described. Video memory 72 is updated by the addition of new data which is put in video memory two strips at a time as shown at 80 and 82. The two strips of new data shown at 80 and 82 comprise identical strips of data which are placed 88 bytes apart within video memory to fill columns A and B thereof. The screen memory 70 is panned to the right to view new data placed in column B shown at 82 to allow continuous panning beyond screen memory 70. As panning to the right is continued for reviewing column B at 82, new data may be placed in video memory to fill columns at A +1 and B+1 as shown by 84 and 86 respectively. Panning continues to view a new strip of data at B +1 as shown at 86 and this process is repeated until column C as shown at 88 as filled with new data and viewed in the panning process.

As will be recognized, at this point there will be two duplicate memory images in video memory with the first extending from column A shown at 80 to column B−1 one as shown at 90 and a duplicate image starting at column B as shown at 82 extending to column C as shown at 88. When the right edge 92 of video memory is reached in the panning process, the start address register 62 (as shown in FIG. 2) of the CRT controller 30 is updated such that screen memory 70 is moved to its starting position 8 bytes from the left edge of video memory as shown at 78. It should be recognized that by duplicating the image to be displayed within video memory 72, the screen memory may be updated so as to re-display the image which is seen on the CRT when the right edge 92 of video memory is reached by this process, the need to refresh the displayed image when the limits of video memory are reached is eliminated and no microprocessor functions to enable such refreshing are necessary. Upon updating of the screen memory to its starting position 8 bytes from the left edge of video memory as shown at 78, new data may again may be placed in video memory two strips at a time, 88 bytes apart in columns A and B as shown at 80 and 82 respectively. Panning and updating of video memory may then be accomplished in a continuous manner as previously described without the bounds of video memory placing any restraints upon the panning process. Continuous panning in the smooth panning mode described is extremely quick and efficient as there is no need to stop and refresh the image data which placed restraints on panning in the prior art. Thus, with the smooth panning mode of the invention, the user is now able to display acquired data in real time such that acquisition and display may occur virtually simultaneously. Thus, the user has a great amount of flexibility in a variety of disciplines regardless of the amount of data and individual requirements.

For example, continuous streaming of acquired data in a acquisition program wherein the acquired data is directed to a memory location, may also be displayed directly on a CRT by means of the continuous smooth panning mode of the invention. In many applications such as waveform data as generated by electrical or electronic potentials, mechanical shock or vibration as well as other measurements such as pressure, acceleration, temperature and the like, and physical potentials such as encephalography, cardiography and the like may be displayed in real time. These measurements are acquired by transforming the analog waveform data into digital values which may be stored in video memory for generation on a display screen and viewed in the smooth panning made. Similarly, existing data sets may be viewed at a high rate of speed utilizing the continuous panning method of the invention regardless of the size of the data set.

It is another aspect of the invention to enable the user to take real time measurements of the data set by the inclusion of grid lines into video memory along with the other data to be displayed. The grid lines may be amplitude or timing lines for example which may be adjusted for the particular measurements being conducted. The grid lines will be displayed along with acquired data on the display screen or a CRT screen such that actual measurements may be taken on the data immediately during the acquisition thereof to insure proper data quality and results. In a similar fashion to continuous panning of data as previously described, the grid, timing, amplitude lines or the like are panned along with other data so as to provide a continuous reference by which the data may be measured and evaluated. These grids or timing lines are continuously panned without having to stop and refresh the view image every time an edge of video memory is encountered or after each pan.

Figure 5:
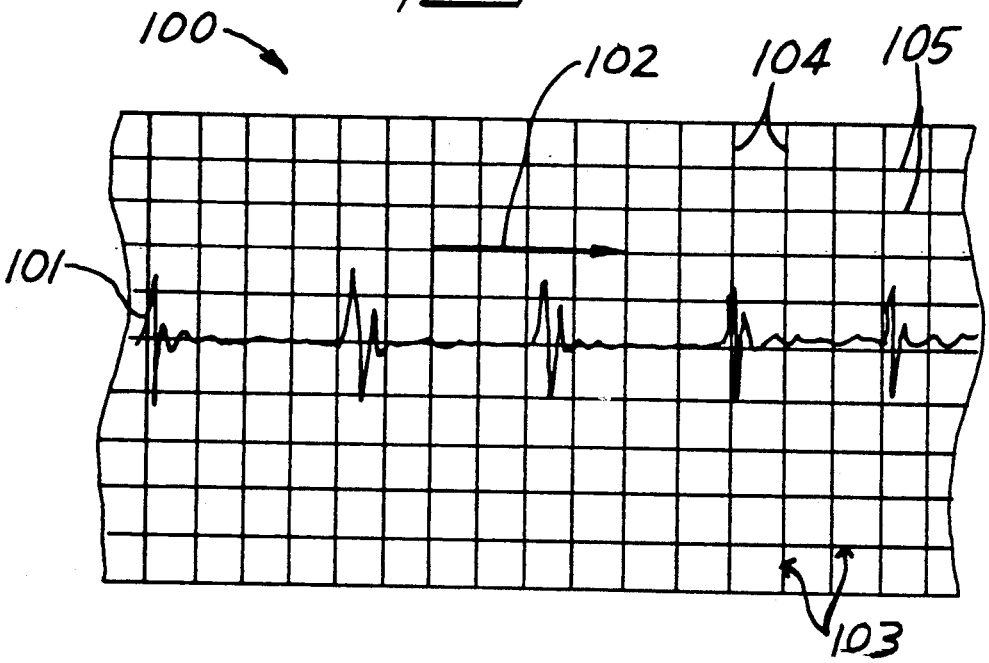
FIG. 5 is an example of a real time display which may be utilized in conjunction with the panning function of the invention.

An example of waveform data which may be utilized with the continuous smooth panning mode of the invention is shown in FIG. 5 wherein a display image is shown by 100. Waveform data such as cardiograph signals 101 show an example of physical potentials which are desired to be viewed in a real time mode to monitor the condition of a patient in the medical environment. The waveforms 101 are made to pan in the direction shown by 102 in a continuous fashion wherein video memory in the video controller of the display system is continuously updated with newly acquired data and to provide duplicate images within video memory as previously described. Grid lines 103 which may comprise timing and amplitude measurement lines may be provided as shown at 104 and 105 respectively for part of video memory such that they will be displayed continuously during the panning process for continuous real time reference and measurement capabilities.

Figure 6:
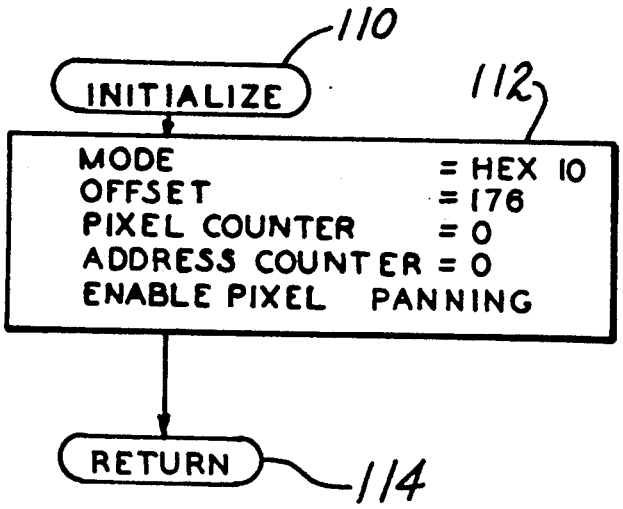
FIG. 6 is a flow diagram showing initialization of the video mode used for panning in the present invention.
Figure 7:
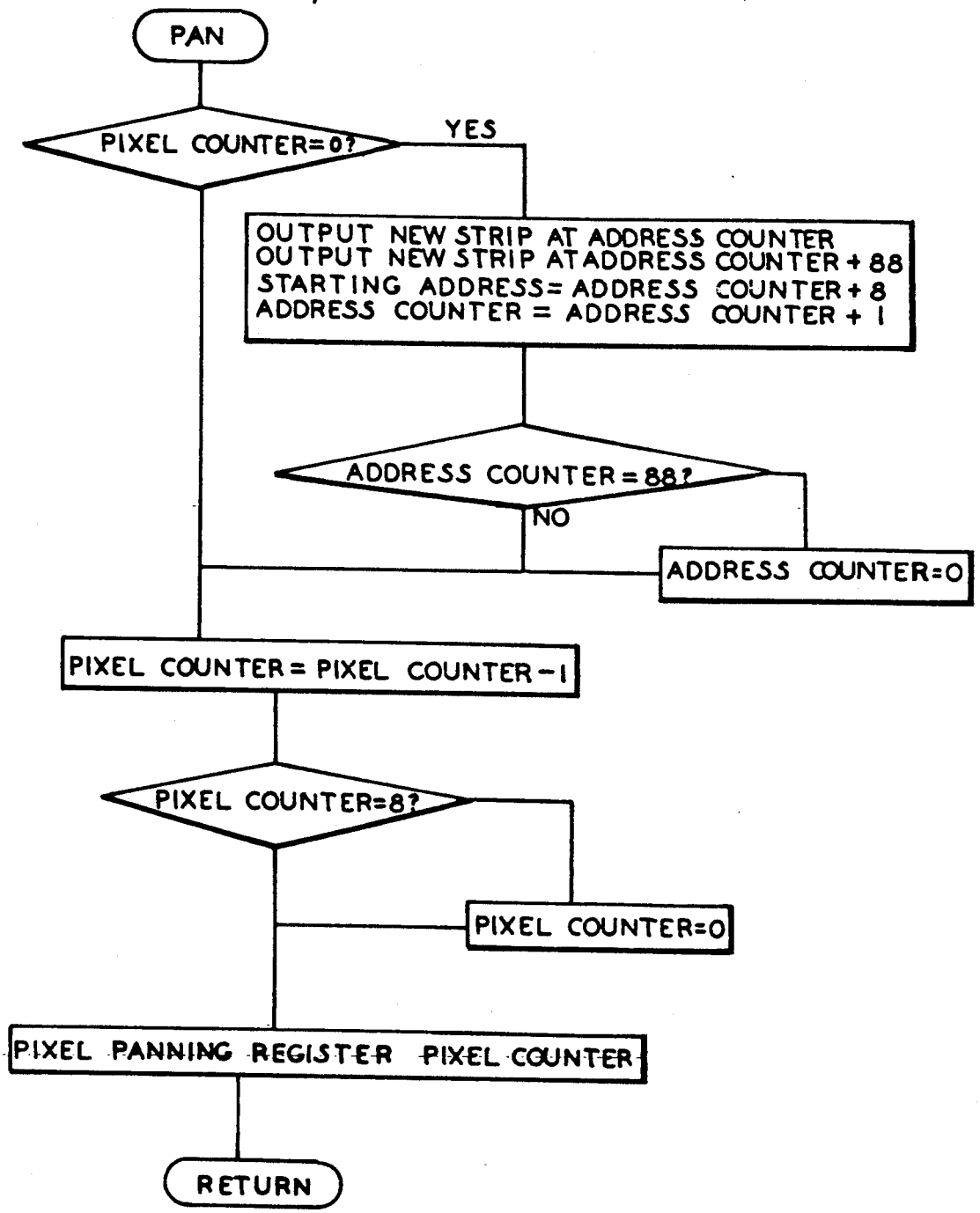
FIG. 7 is a flow diagram showing the method of panning beyond the edges of video memory in the present invention.

Turning now to FIGS. 6 and 7 there is shown the implementation of the continuous smooth panning mode of the invention. The user may request the smooth panning mode by means of appropriate instructions received by the microprocessor 10 as shown in FIG. 1. The flow chart as shown in FIG. 6 shows initialization of smooth panning mode wherein panning instructions are received by the microprocessor and initialization takes place at step 110. For such initialization, the video mode is set to Hex 10 so as to allow the video image to be panned up to 8 pixel positions utilizing the panning register 52 as shown in FIG. 2. Additionally at step 112, the offset register 60 of the CRT controller 30 a shown in FIG. 2 sets the logical screen width of the video controller at 176 such that the next byte row in video memory will be larger than the current byte row by at least twice the physical screen dimensions of 80 bytes plus one byte. Additionally, the pixel counter and address counters within the video controller are set to zero to enable pixel panning as previously described. At step 114, the microprocessor returns to the point in the program at which it was operating when panning instructions were received.

Once pixel panning has been initiated the continuous smooth panning mode of the invention is implemented as shown in FIG. 7. When panning is initiated as in FIG. 6, as shown at step 120 in FIG. 7, the video memory will be configured as shown in FIG. 4 so as to enable continuous smooth panning. The microprocessor 10 first checks to see whether or not the pixel counter is set to 0 at step 122 to signal initialization of panning as shown in FIG. 6. If the pixel counter equals 0 and panning has been implemented, there is output a new strip of data at the address counter or position 93 as shown in FIG. 4. Simultaneously, an identical strip of new data is output at the address counter plus 88 bytes as shown at 94 in FIG. 4. The starting address of screen memory is then placed 8 bytes to the right of the left edge 76 of video memory as shown at 78 in FIG. 4. The address counter is then incremented to finish the steps as shown in 124.

At step 126, the microprocessor will check to see if the address counter has been incremented to reach the 88th byte or the right edge of screen memory 70 as shown in FIG. 4. Initially the address counter will not equal 88 and panning can begin within video memory wherein the pixel counter is first incremented at step 130 and the microprocessor will check at step 132 whether the pixel counter has been incremented to equal 8 which is the maximum value for the particular video mode utilized in the preferred embodiment of the invention. Initially the pixel counter will not equal 8 and panning register 52 as shown in FIG. 4 is incremented along with the pixel counter so as to allow the video image to be shifted by one pixel position.

In step 138, the microprocessor returns to step 120 so as to continue the panning process wherein the pixel counter is again checked to see whether or not it is set to zero by the system microprocessor. It is recalled that the pixel counter had been incremented and will not have a value of zero such that it will be again incremented at step 130 to allow further shifting of the video image as previously described. It is seen that until the pixel counter has been incremented to equal a value of 8 as checked at step 132, the shifting of the video image one pixel at a time will continue.

Upon shifting of to the maximum number of pixels which are able to be panned in the video mode and incrementing the pixel counter, the pixel counter will be reset to equal 0 at step 134 whereupon after the return at step 138 the pixel counter will again register a 0 value at step 122 to implement the output of two new identical strips of data at the address counter and the address counter plus 88 as shown in step 124. The starting address is then set at a value 8 bytes from the previously incremented address counter and the address counter is again incremented at step 124. It will be seen that until the address counter reaches a value of 88 which is checked at step 126, the panning within video memory will continue in steps 130–136 and new strips of data will be output periodically after the maximum number of pixel positions for the video mode has been reached.

It will be recognized that updating of the video memory is done in conjunction with the panning carried out by panning register 52 as shown in FIG. 2. The screen memory 70 as shown in FIG. 4 will be panned for example to the right as shown at arrow 74 so as to fill and view strips of data at column B as shown at 82 in FIG. 4 along with subsequent columns of newly output data at B +1, B+2, . . . , and column C as shown at 88 in FIG. 4. This process continues until column C is filled and viewed by panning, at which time microprocessor will check the value of the address counter at step 126. At this point, the address counter will then equal 88 or be positioned at the location as indicated by 94 in FIG. 4.

It should be recognized that the screen memory has been shifted until the right edge 92 of video memory has been reached at which time the address counter is reset to a 0 value at step 128. It should be recognized that at this point there will be two duplicate memory images in video memory whereby resetting of the address counter at step 128 enables the proper image data to be displayed without stopping to refresh the image data when the right edge 92 of video memory was reached. In this way, the time consuming steps of refreshing the image data are avoided thereby freeing the microprocessor to continue updating video memory as well as panning thereby allowing real time image display as desired. After resetting of the address counter at step 128, panning will continue and the video memory updated at step 124 with new strips of data in columns A and B as shown at 80 and 82 respectively in FIG. 4. Screen memory is moved to its starting position 8 bytes from the left edge of video memory and the address counter is again incremented at step 124 to continue panning of data through memory which is larger than the video memory without stopping to refresh all the video every time the edge of video memory is reached.

The programmable video graphic controller to enable smooth panning and the method of smooth panning through memory which is larger than video memory allows a great amount of flexibility in the use of a video display system. Although the present invention has been defined in terms of a simplified illustrative example utilizing a somewhat generalized block diagram presentation and preferred particular embodiments of the method and system, it is contemplated that alterations and modifications may be made without departing form the scope of the invention as defined in the appended claims. It should be appreciated that the display system utilizing a video graphic controller in the manner of the invention as well as the method of smooth panning provides a extremely versatile and useful system for both real time data acquisition and display systems as well as viewing existing data sets in an optimized fashion. It should be appreciated that the invention has been described in terms of panning in one direction, but various modifications such as panning in an alternate direction, selectively stopping the panning process, split-screen displays and other various well know display options may be utilized in conjunction with the panning capabilities of the invention.

What is claimed is:

1. A method of operating a display system for displaying data from a video memory to allow panning through virtual video memory which is larger than the video memory of the display system comprising the steps of:

(1) defining the logical screen width within video memory to be a predetermined width which is larger than screen memory, (2) setting a start address of said screen memory at a predetermined position relative to an edge of said video memory, (3) storing in said video memory initial first and second identical strips of graphic image data being positioned at predetermined locations within said video memory, (4) incrementing a panning register so as to move said screen memory through a predetermined number of pixels within said video memory, (5) storing in said video memory a further first strip of graphic image data being positioned at a predetermined location in said video memory relative to said initial first strip of graphic image data, and a further second strip of graphic image data identical to said further first strip and being positioned at a predetermined position relative to said initial second strip of graphic image data in video memory, (6) repeating steps 4 and 5 with said further first and second strips being positioned at predetermined positions relative to one another respectively until said video memory has been filled with graphic image data ad shifting of said screen memory to an edge of said video memory is completed, (7) resetting said start address of said screen memory a predetermined length from said edge of said video memory, (8) repeating steps 3–7 so as to continuously pan graphic image data through virtual video memory which is larger than video memory without having to stop and refresh said graphic image data when an edge of said video memory is reached.

2. A method as in claim 1, wherein, said logical screen width is defined to be at least two times larger plus one byte than said screen memory.

3. A method as in claim 1, wherein, said screen memory comprises a width of 80 bytes of graphic image data an said logical screen width is defined to be 176 bytes.

4. A method as in claim 1, wherein, said start address of said screen memory is positioned 8 bytes from a left edge of said video memory.

5. A method as in claim 1, wherein, said initial first strip of graphic image data is positioned at a left edge of said video memory and said initial second strip of graphic image data is positioned 88 bytes from said initial first strip of graphic image data within said video memory.

6. A method as in claim 1, wherein, two duplicate memory images are positioned in video memory such that upon reaching an edge of said video memory, said screen memory may be repositioned from viewing one of said duplicate memory images to view the other of said duplicate memory images and continue panning thereof without stopping to refresh the viewed graphic image data.

7. A method as in claim 1, wherein, said graphic image data includes background grid lines which are able to be panned continuously with additional graphic image data without having to continuously refresh said background graphic image data after shifting of said graphic image data in the panning process.

8. A method as in claim 7, wherein, said background graphic image data comprises timing or amplitude measurement lines to enable a user to make measurements of the displayed graphic image data.

9. A method of operating a video graphic controller for displaying a portion of data contained in a video memory upon a display screen, wherein the video graphic controller and display system includes means with which to define the logical screen width within video memory and means to enable shifting of said graphic image data one or more pixel positions on said display screen, wherein said method includes the steps of:

(1) defining said logical screen width with respect to said video memory to be a predetermined width relative to said display screen, (2) positioning a screen memory means for storing graphic image data which is to be displayed on said display screen at a predetermined position within said video memory whereby said means to shift said graphic image data acts to shift said screen memory within said video memory, (3) updating said video memory with initial first and second identical strips of graphic image data positioned at predetermined locations within said video memory, (4) panning through said memory by implementation of said means to shift said screen memory a plurality of pixel positions within said video memory, (5) updating the start address of said screen memory after shifting of a predetermined number of pixels within said video memory, (6) updating said video memory with further first and second identical strips of graphic image data positioned at predetermined positions in video memory and with said further first strip being contiguous to said initial first strip and said further second strip being contiguous to said initial second strip, (7) repeating steps 4 and 5 and updating said video memory repeatedly with further identical strips of graphic image data being positioned contiguously to said further first and second strips updated in step 6, until said screen memory has been shifted to the position of said initial second strip of graphic image data, (8) updating the position of said screen memory within said video memory so as to again be positioned at said predetermined position within said video memory, (9) repeating steps 3 through 8 so as to enable continuous panning through virtual video memory which is larger than said video memory without having to stop and refresh said graphic image data when an edge of video memory is reached.

10. A video display system having a programmable video graphic controller to enable smooth panning of graphic image data comprising:

screen memory means for storing graphic image data which is to be displayed on a display screen, video memory means for storing graphic image data having dimensions larger than said screen memory means such that additional storage for said graphic image data is available outside of said screen memory, means to define the logical screen width within said video memory to be at least twice said screen memory plus one byte, output means to output a plurality of identical initial strips of graphic image data to predetermined positions within said video memory, means to set the start address of said screen memory, shifting means to enable panning of said screen memory by a predetermined number of pixels, counting means to indicate when said screen memory has been shifted said predetermined number of pixels, means to update said counting means and to continue panning by said shifting means to enable output means to output a further plurality of identical strips of graphic image data with each strip of said further plurality of strips being positioned at predetermined positions relative to each of said initial plurality of strips respectively and to said further plurality of strips respectively within said video memory, counting means to indicate when said screen memory has reached an edge of said video memory, reset means for updating of said start address of said screen memory within said video memory.

11. A video display system as in claim 10, wherein, said means to define the logical screen width is an offset register associated with said programmable video graphic controller.

12. A video display system as in claim 11, wherein, said offset register sets said logical screen width to be 176 bytes and said screen memory has a width of 80 bytes.

13. A video display system as in claim 10, wherein, said output means positions said two identical strips 88 bytes apart within said video memory.

14. A video display system as in claim 10, wherein, said shifting means comprises a panning register forming part of an attribute controller.

15. A method of operating a display system for displaying data from a video memory to allow panning through virtual video memory which is larger than said video memory of the display system comprising the steps of:

(1) defining the logical screen width within video memory to be a predetermined width which is larger than a screen memory of said display system, (2) storing in said video memory an initial plurality of strips identical graphic image data at predetermined positions within said video memory, (3) panning through said video memory by shifting said screen memory within said video memory, (4) repeatedly updating said video memory with a further plurality of strips of identical graphic image data with each of said further plurality of strips positioned at predetermined positions within said video memory relative to each of said initial plurality of strips respectively and to each of subsequent strips placed in said video memory in the step of updating said video memory respectively, so as to form two duplicate memory images within said video memory, and (5) updating the location of said screen memory when an edge of said video memory is reached so as to continuously pan graphic image data through virtual video memory which is larger than said video memory without having to stop and refresh said graphic image data.

* * * * *